US011473524B2

(12) United States Patent
Inoue et al.

(10) Patent No.: US 11,473,524 B2
(45) Date of Patent: Oct. 18, 2022

(54) RECIPROCATING MOTION ENGINE

(71) Applicant: Twinbird Corporation, Tsubame (JP)

(72) Inventors: Mineyuki Inoue, Tsubame (JP); Kazuya Tsuji, Tsubame (JP); Jun Komada, Tsubame (JP); Takeshi Suzuki, Tsubame (JP)

(73) Assignee: Twinbird Corporation, Tsubame (JP)

( * ) Notice: Subject to any disclaimer, the term of this patent is extended or adjusted under 35 U.S.C. 154(b) by 0 days.

(21) Appl. No.: 17/422,623

(22) PCT Filed: Jan. 15, 2020

(86) PCT No.: PCT/JP2020/000959
§ 371 (c)(1),
(2) Date: Jul. 13, 2021

(87) PCT Pub. No.: WO2020/153179
PCT Pub. Date: Jul. 30, 2020

(65) Prior Publication Data

US 2022/0090559 A1 Mar. 24, 2022

(30) Foreign Application Priority Data

Jan. 25, 2019 (JP) ..... JP2019-010750

(51) Int. Cl.
*F02G 1/043* (2006.01)
*F02G 1/053* (2006.01)
*F25B 9/14* (2006.01)

(52) U.S. Cl.
CPC ..... *F02G 1/0435* (2013.01); *F02G 1/053* (2013.01); *F25B 9/14* (2013.01); *F02G 2243/02* (2013.01);
(Continued)

(58) Field of Classification Search
CPC ..... F02G 2270/00; F02G 2270/005; F02G 2270/95; F02G 1/04–06;
(Continued)

(56) References Cited

U.S. PATENT DOCUMENTS 5,582,013 A * 12/1996 Neufeld ..... F16F 15/02 60/520
6,857,267 B2 * 2/2005 Yamagiri ..... F02G 1/0435 60/524
(Continued)

FOREIGN PATENT DOCUMENTS

JP 01-137161 A 5/1989
JP 08-312460 A 11/1996
(Continued)

OTHER PUBLICATIONS

International Search Report dated Mar. 3, 2020 for the corresponding International Patent Application No. PCT/JP2020/000959.

*Primary Examiner* — Mickey H France
(74) *Attorney, Agent, or Firm* — Leason Ellis LLP

(57) ABSTRACT

A Stirling refrigerator serves as a reciprocating motion engine and has: a casing; a cylinder arranged within the casing; a piston capable of being reciprocated within the cylinder in a reciprocating direction as being uniaxial; a control circuit electrically controlling movement of the piston; a damping unit provided at one end side of the casing in the reciprocating direction via a first connection part and a second connection part serving as connection parts; and a vibration detection board arranged via an attachment body on the second connection part, said vibration detection board serving as a vibration detector to detect a vibration in the reciprocating direction, caused by the reciprocating movement of the piston, to transmit it to the control circuit.

4 Claims, 6 Drawing Sheets

(52) U.S. Cl.
CPC ..... *F02G 2275/10* (2013.01); *F02G 2275/20* (2013.01); *F25B 2309/1428* (2013.01)

(58) Field of Classification Search
CPC ..... F02G 2243/00–54; F02G 2275/10; F02G 2275/20; F25B 2309/1428; F25B 9/14
USPC ..... 60/516–531, 508–515; 62/6, 238.2
See application file for complete search history.

(56) References Cited

U.S. PATENT DOCUMENTS

| | | | | |
|---|---|---|---|---|
| 2002/0121816 | A1* | 9/2002 | Qiu | F16F 7/1011 310/12.24 |
| 2005/0268604 | A1 | 12/2005 | Takahashi et al. | |
| 2016/0252280 | A1* | 9/2016 | Suzuki | F28D 1/0226 62/6 |

FOREIGN PATENT DOCUMENTS

| | | | |
|---|---|---|---|
| JP | 2005-9475 | A | 1/2005 |
| JP | 2011-177312 | A | 9/2011 |

* cited by examiner

RECIPROCATING MOTION ENGINE

CROSS-REFERENCE TO RELATED PATENT APPLICATIONS

This application is a U.S. National Phase Application under 35 U.S.C. § 371 of International Patent Application No. PCT/JP2020/000959 filed on Jan. 15, 2020 and claims the benefit of priority to Japanese Patent Application No. 2019-010750 filed Jan. 25, 2019, the contents of both of which are incorporated herein by reference in their entireties. The International Application was published in Japanese on Jul. 30, 2020 as International Publication No. WO/2020/153179 under PCT Article 21(2).

FIELD OF THE INVENTION

The present invention relates to a reciprocating motion engine such as a Stirling cycle engine that contains a piston being reciprocated within a cylinder.

BACKGROUND OF THE INVENTION

Conventionally, as a reciprocating motion engine of such type, there has been known a reciprocating type expander (see, for example, JP-A-H01-137161) serving as a reciprocating motion engine provided with: a casing that also works as a cylinder, a piston capable of being uniaxially reciprocated within the cylinder, a control circuit that electrically controls the movement of the piston, wherein a vibration sensor is provided within the casing. Such a reciprocating type expander detects a frequency of impact between the piston and an inner wall of the cylinder end portion by using the vibration sensor to regulate a fluid flow control valve, in accordance with this detection result, to thereby control the compressor to reduce collision noise and vibration.

PRIOR ART DOCUMENT(S)

Patent document 1: JP-A-H01-137161

Problems to be Solved by the Invention

Unfortunately, according to such structure, the vibration sensor is attached to an outer end face of the middle-pressure chamber of the expander. For this reason, in the case where the expander is a pressure vessel, there has been a risk of leakage of working gas or a breakage thereof at the attachment position of the vibration sensor in the expander.

An object of the present invention is to solve the above problems and to provide a highly reliable reciprocating motion engine.

SUMMARY OF THE INVENTION

Means to Solve the Problems

A first aspect of the present invention is a reciprocating motion engine including: a casing; a cylinder arranged within the casing; a piston capable of being reciprocated in a uniaxial direction within the cylinder; a control circuit to electrically control a movement of the piston; and a damping unit provided at a one end side in the uniaxial direction via a connection part; wherein the reciprocating motion engine further comprises: a vibration detector to detect a vibration in the uniaxial direction that is caused by a reciprocating movement of the piston, and then transmit it to the control circuit, said vibration detector being provided at the connection part.

A second aspect of the present invention is a reciprocating motion engine as set forth in the first aspect, wherein a dimension of the connection part in a direction orthogonal to the uniaxial direction is formed smaller than a dimension of the casing or the damping unit in a direction orthogonal to the uniaxial direction.

A third aspect of the present invention is a reciprocating motion engine as set forth in the first aspect, wherein an acceleration sensor is utilized in the vibration detector.

A fourth aspect of the present invention is a reciprocating motion engine as set forth in the third aspect, wherein the acceleration sensor has a device element having dimensions that differ from one another in respective detection axis directions among which a detection axis direction corresponding to the smallest dimension of the device element of the acceleration sensor is orthogonal to the uniaxial direction.

Effects of the Invention

The reciprocating motion engine according to the first aspect of the invention is configured as explained above and hence the attachment of the vibration detector does not adversely influence the casing to thereby provide a reciprocating motion engine of high reliability.

Further, since a dimension of the connection part in a direction orthogonal to the uniaxial direction is formed smaller than a dimension of the casing or the damping unit in a direction orthogonal to the uniaxial direction, the vibration detector is allowed to have minimal influence on the overall size of the reciprocating motion engine.

Further, since an acceleration sensor is utilized in the vibration detector, an amplitude of the piston can be determined based on the magnitude of the detected acceleration to control the amplitude of the piston.

Further, since the acceleration sensor has a device element having dimensions that differ from one another in respective detection axis directions among which a detection axis direction corresponding to the smallest dimension of the device element of the acceleration sensor is orthogonal to the uniaxial direction, there can be avoided a decrease in sensitivity of the detection signal to thereby suppress reactivity deterioration in vibration detection for controlling the movement of the piston with a high degree of accuracy.

DETAILED DESCRIPTION OF THE INVENTION

Figure 1:
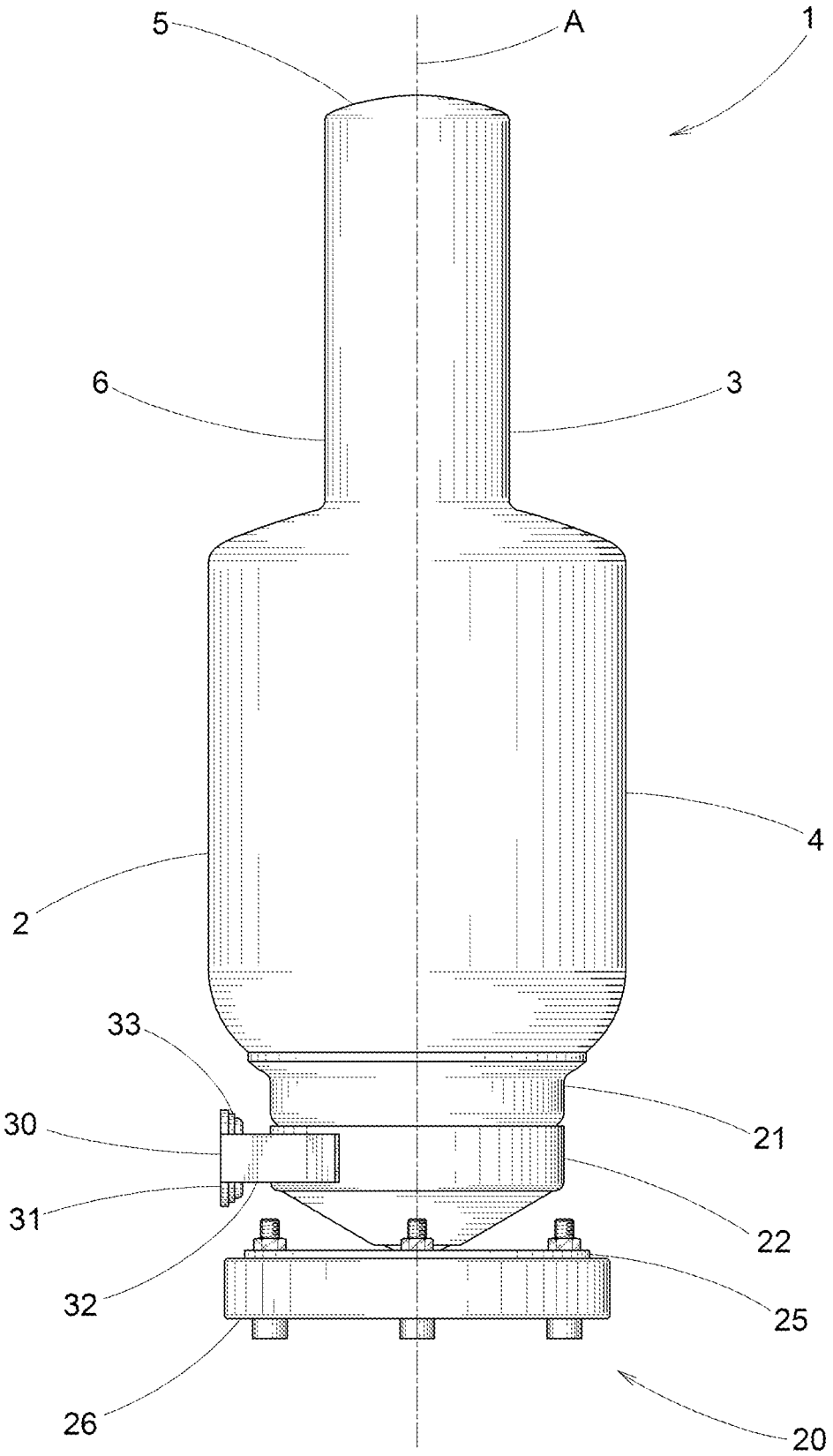
FIG. 1 is an external view of the Stirling refrigerator serving as a reciprocating motion engine which illustrates an embodiment of the present invention.
Figure 2:
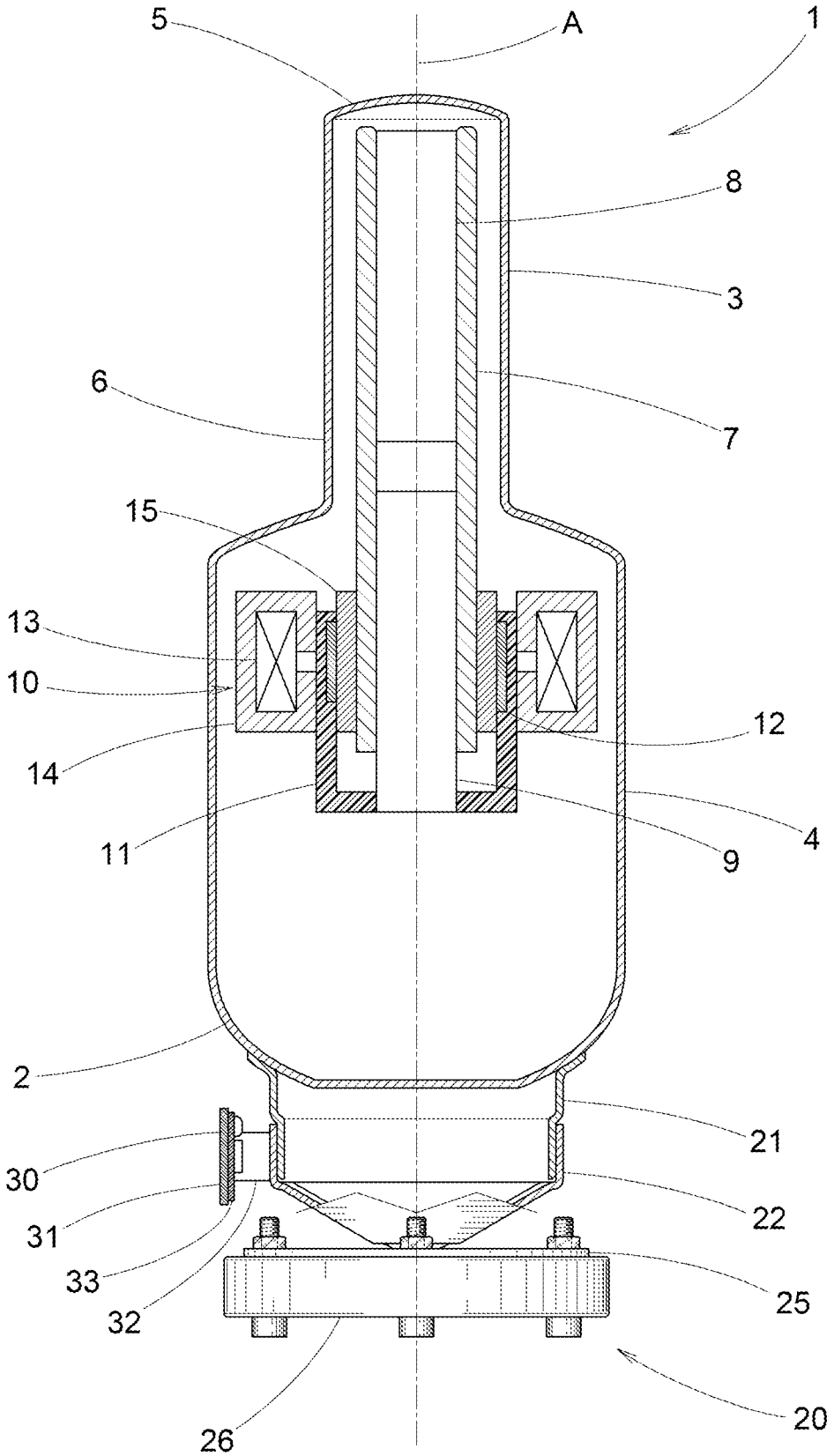
FIG. 2 is a longitudinal sectional view of the Stirling refrigerator serving as a reciprocating motion engine which illustrates an embodiment of the present invention.
Figure 3:
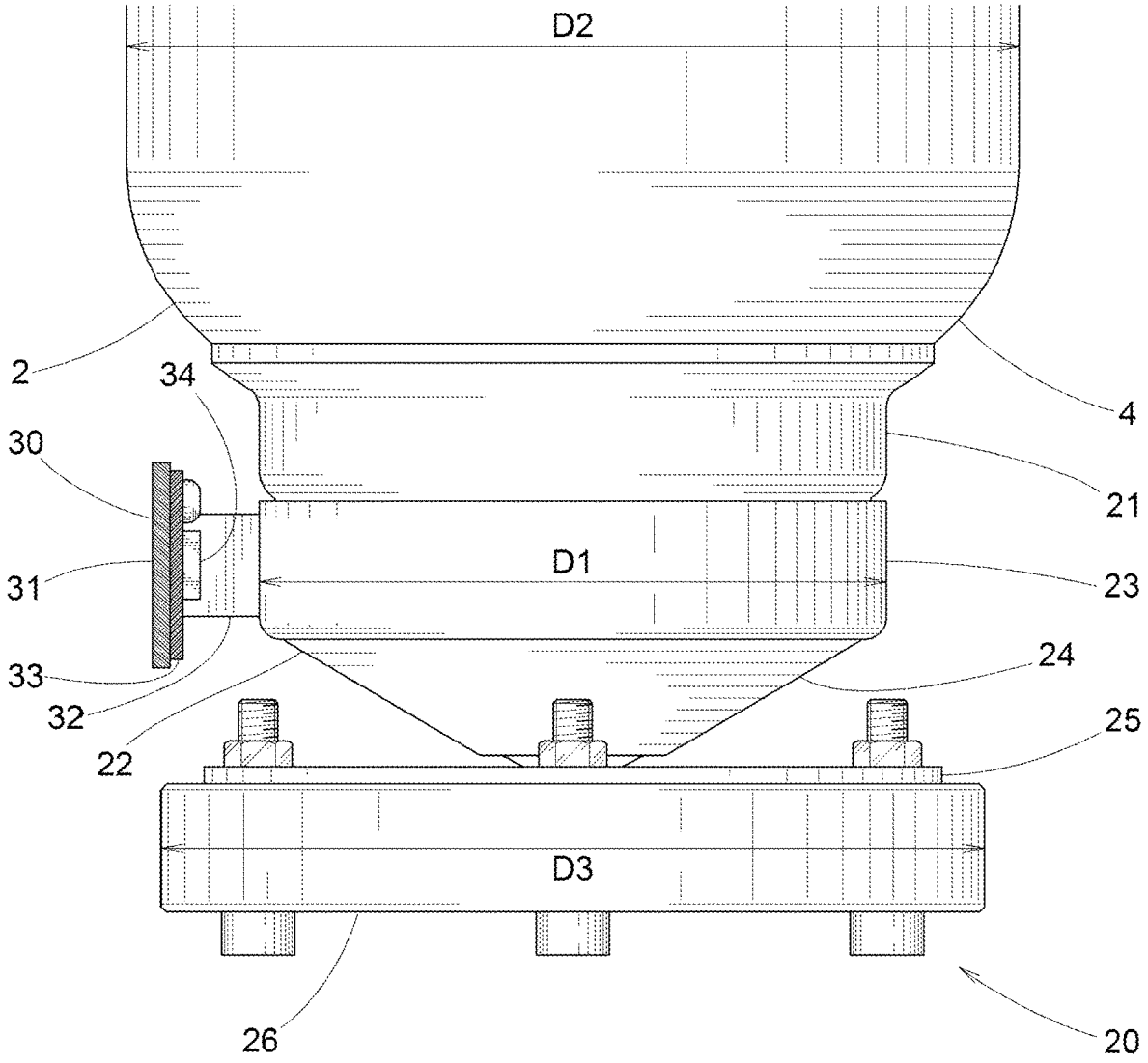
FIG. 3 illustrates an enlarged and partial cross-sectional view of a main section of the Stirling refrigerator serving as a reciprocating motion engine which illustrates an embodiment of the present invention.

Embodiments of the present invention will now be described hereunder with reference to the accompanying FIGS. 1 to 5. Numeral 1 denotes a Stirling refrigerator as a reciprocating engine according to the present invention. This Stirling refrigerator 1 includes a metallic casing 2. This casing 2 includes and is formed by: a cylindrical portion 3 formed into a small-diameter cylindrical shape, and a body portion 4 having a large-diameter cylindrical shape. The cylindrical portion 3 includes a closed distal portion 5 and a basal portion 6.

Within the cylindrical portion 3, a cylinder 7, extended up to the inside of the body portion 4, is interposed coaxially with respect to the cylindrical portion 3. That is, the cylinder 7 has a central axis line A that is identical to the central axis line A of the cylindrical portion 3. Inside the distal side of the cylinder 7, a displacer 8 is accommodated in a manner being slidable in a reciprocating direction R that is a uniaxial direction in parallel with the central axis line A. Further, within the body portion 4 and inside the basal side of the cylinder 7, a piston 9 is accommodated in a manner being slidable in a reciprocating direction R that is a uniaxial direction in parallel with the central axis line A. The basal portion of the piston 9 is coaxially connected to a drive mechanism 10. The drive mechanism 10 includes: a short-cylindrical frame 11 that is connected to the basal end of the piston 9 and coaxially extended and arranged therewith around the outer periphery of the basal side of the cylinder 7, a cylindrical permanent magnet 12 fixed to one end of the frame 11, a ring-shaped electromagnetic coil 13 provided adjacent to the outer periphery of the permanent magnets 12, a core 14 with the electromagnetic coil 13 being wound therearound, and a magnetism conducting portion 15 provided adjacent to the inner periphery of the permanent magnet 12.

Herein, numeral 20 in FIG. 1 refers to a damping unit provided at an end portion of the body portion 4 of the casing 2. The damping unit 20 is attached thereto via a first connection part 21 fixed to an end portion of the body portion 4 and via a second connector 22 fixed to the first connection part 21 such that the damping unit 20 is arranged coaxially with the central axis line A of the cylinder 7. That is, these first and second connection parts 21 and 22 constitute a connection part for fixing the damping unit 20 to the casing 2. Further, the damping unit 20 is arranged such that a flat spring 25 and a balance weight 26 are stacked coaxially with the central axis line A.

The first connection part 21 is formed to have a short cylindrical shape. The second connection part 22 has a short cylindrical portion 23 and a conical portion 24. The damping unit 20 is connected using, e.g., a screw to an apex portion of the conical portion 24 of the second connection part 22. The second connection part 22 is connected to the first connection part 21 using, e.g., a screw. The diameter D1 of the second connection part 22 is smaller than the diameter D2 of the body portion 4, and smaller than the diameter D3 of the damping unit 20.

An attachment body 30 is fixed to the short cylindrical portion 23 of the second connection part 22. This attachment body 30 is formed of a metal, and includes a plate-shaped board attachment portion 31 and a pair of arms 32. The pair of arms 32 is fixed to the second connection part 22 to thereby attach the attachment body 30 to the second connection part 22. Although not explicitly shown in the figure, the arms 32 are fixed to the second connection part 22 via, e.g., a screw. Also, fixed on the inner side of the board attachment portion 31 is a vibration detection board 33 that serves as a vibration detector. As the vibration detection board 33 is fixed to the inner surface side of the board attachment portion 31, there can be reduced a risk that the vibration detection board 33 is hit and broken by something. Further, an acceleration sensor 34 is mounted on the vibration detection board 33. This acceleration sensor 34 is of a triaxial type having detection axes X, Y, and Z.

Figure 4:
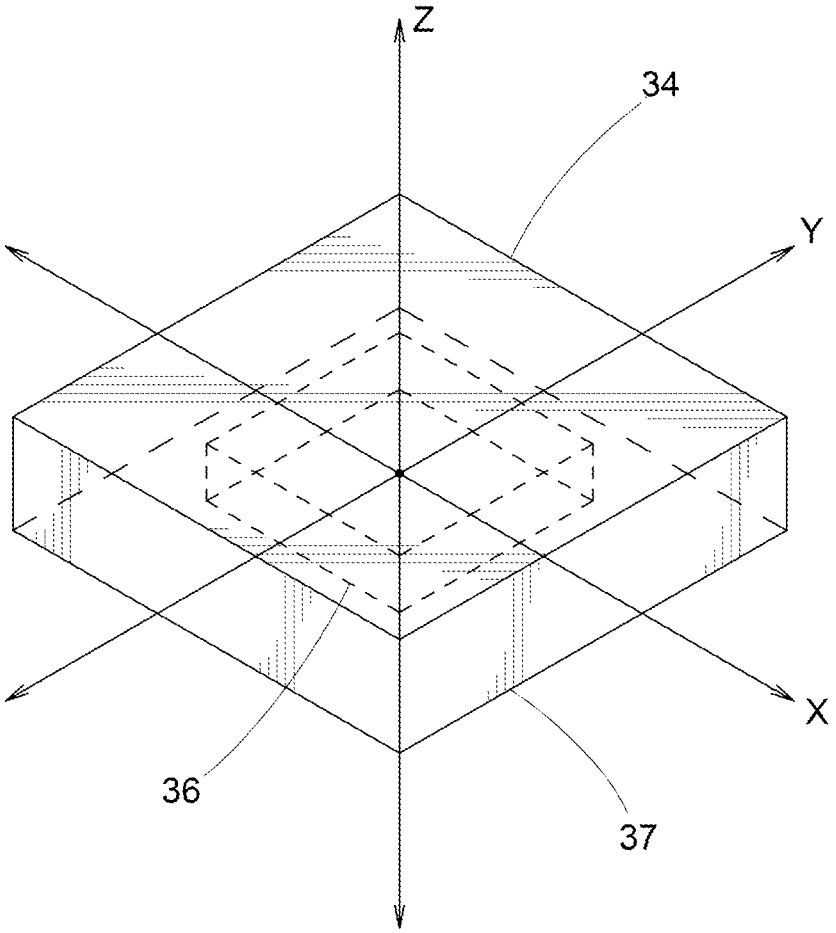
FIG. 4 is a perspective view of an acceleration sensor to be implemented in the vibration detector of the Stirling refrigerator serving as a reciprocating motion engine which illustrates an embodiment of the present invention.
Figure 5:
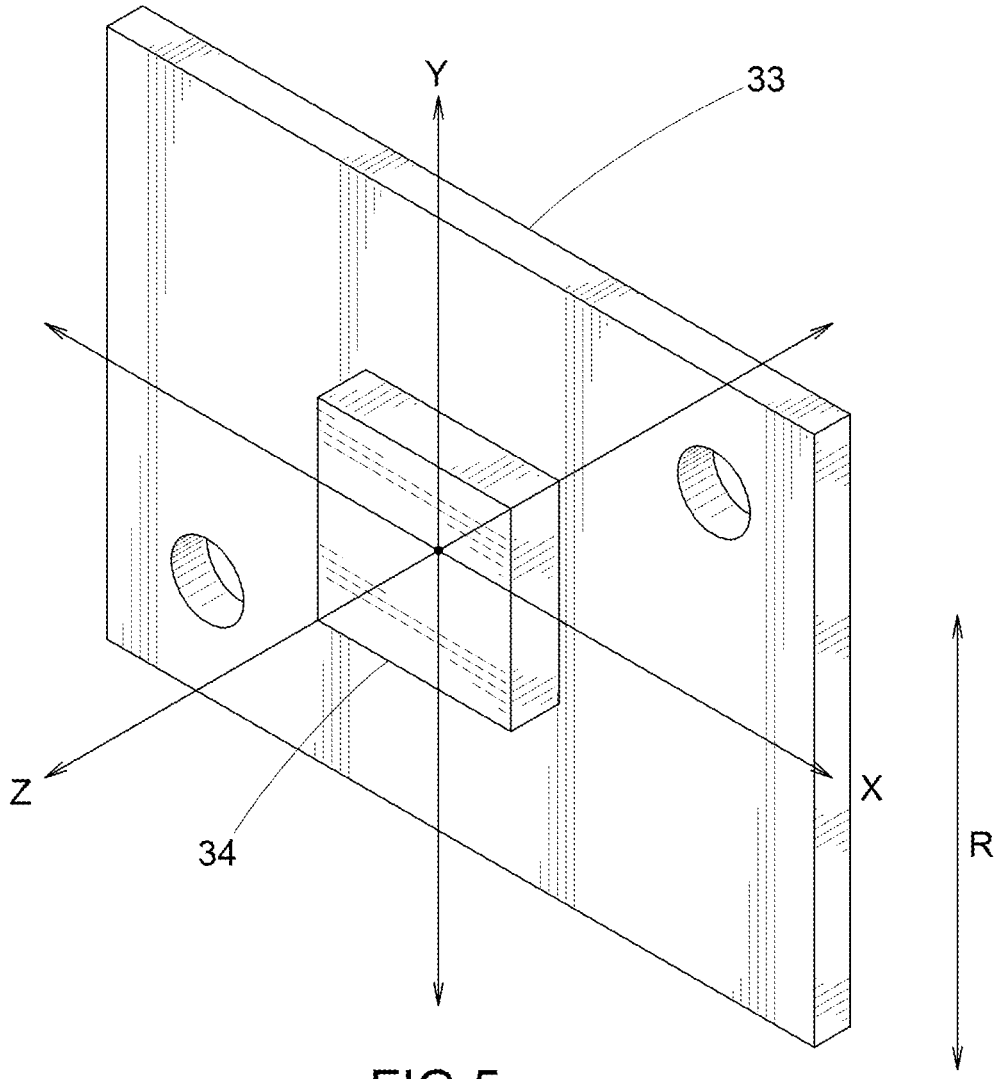
FIG. 5 is a perspective view of the vibration detector of the Stirling refrigerator serving as a reciprocating motion engine which illustrates an embodiment of the present invention.
Figure 6:
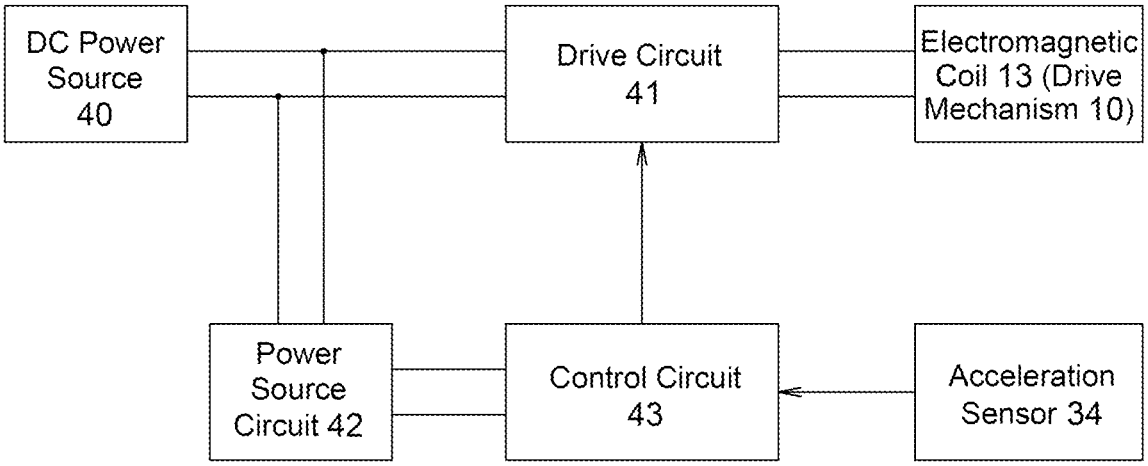
FIG. 6 It is a block diagram of the electric circuit of the Stirling refrigerator serving as a reciprocating motion engine which illustrates an embodiment of the present invention.

This acceleration sensor 34 will be described in detail. The acceleration sensor 34 includes and is comprised of a device element 36 and a package 37. The device element 36 is provided within the package 37. Further as shown in FIG. 4, the device element 36 is configured to have a dimension in the direction of detection axis Z that is smaller than the dimensions in the directions of detection axes X and Y. For this reason, the device element 36 is more flexible in the direction of the detection axis Z than those in the directions of detection axes X and Y. Further, as shown in FIG. 4, the package 37 is formed of a cuboid shape having a dimension in the direction of detection axis Z that is smaller than the dimensions in the directions of detection axes X and Y. That is, the shortest direction of the device element 36 matches with the shortest direction of the package 37. As shown in FIG. 5, the vibration detection board 33 is attached to the attachment body 30 such that the direction of detection axis Z, as being the shortest direction of the acceleration sensor 34, is set to be orthogonal to the reciprocating direction R of the displacer 8 and the piston 9, the reciprocating direction R being a uniaxial direction. Here, the reciprocating direction R of the displacer 8 and the piston 9 is a direction of vibration which is parallel with the central axis line A. In the present embodiment, the detection axis Y is set to be in parallel with the reciprocating direction R. Alternatively, it is also possible that the detection axis X is arranged parallel with the reciprocating direction R.

The electric circuit for operating the Stirling refrigerator 1 will be described hereafter. The Stirling refrigerator 1 is configured to operate by converting the direct current, supplied from a DC power source 40, into a given alternating current in a drive circuit 41 and then supplying the current to the electromagnetic coil 13 of the drive mechanism 10. A part of the direct current supplied from the DC power source 40 is supplied to a control circuit 43 after the voltage is converted by the power supply circuit 42. This current activates the control circuit 43. The control circuit 43 then receives input from, e.g., the acceleration sensor 34 to control the operation of the drive circuit 41.

Under this configuration as mentioned above, if the alternating current is applied to the electromagnetic coil 13, then the electromagnetic coil 13 generates an alternating magnetic field, which in turn generates a force to reciprocate the permanent magnets 12 in the reciprocating direction R that is in parallel with the direction of the central axis line A. Due to this force, the piston 9, connected to the frame 11 to which the permanent magnet 12 is fixed, will start reciprocating in the cylinder 7 along the reciprocating direction R. Accordingly, when the piston 9 comes closer to the displacer 8, the displacer 8 is pushed downwardly relative to the piston 9 with a predetermined phase difference. Meanwhile, when the piston 9 moves away from the displacer 8, the displacer 8 is pressed upwardly relative to the piston 9 with the predetermined phase difference. Such operation results in a state in which the distal portion 5 of the cylindrical portion 3 has a low temperature, while the basal portion 6 of the cylindrical portion 3 has a high temperature.

It should be noted that the reciprocating amplitudes of the piston 9 and displacer 8 are not fixed values. For this reason, in some driving conditions, the reciprocating amplitudes of the piston 9 and displacer 8 may grow large such that they may come into collision with each other. Accordingly, the drive mechanism 10 needs to be controlled to prevent the piston 9 and displacer 8 from colliding with each other. In the present invention, it is detected by the signal from the acceleration sensor 34 of the vibration detection board 33 that the reciprocating amplitudes of the piston 9 and the displacer 8 have grown large. The acceleration sensor 34 detects acceleration of vibration that originates from reciprocating movement of the piston 9 and the displacer 8. The control circuit 43 processes the magnitudes of the acceleration, detected by the acceleration sensor 34, as amplitudes of the piston 9 and the displacer 8.

As mentioned above, the vibration detection board 33 is fixed on the inner side of the board attachment portion 31 of the attachment body 30 such that the detection axis Y of the acceleration sensor 34 is in parallel with reciprocating direction R. As such, the device element 36 of the acceleration sensor 34 flexes in the direction of the detection axis Y. Further, as described above, the device element 36 is less flexible in the direction of the detection axis Y than that in the direction of detection axis Z. In this way, as the reciprocating direction R is matched with the detection axis Y as being a direction in which the device element 36 is less flexible, a deterioration in reactivity of the vibration detection can be suppressed so that there can be avoided a decrease in sensitivity of the detection signal of the acceleration sensor 34 as compared to the case where the reciprocating direction R is matched with the detection axis Z as being a direction in which the device element 36 is more flexible. Consequently, the acceleration sensor 34 is capable of detecting increment in amplitude (overstroke) of the piston 9 and the displacer 8 with a high degree of accuracy. This allows the control circuit 43 to control the drive circuit 41 to prevent the piston 9 and the displacer 8 from colliding with each other by overstroke.

As mentioned above, the vibration detection board 33, serving as a vibration detector, is attached via the attachment body 30 to the second connection part 22 constituting the connection part. For this reason, no harmful effect will be brought to the casing 2 as a result of attaching the attachment body 30 for mounting the vibration detection board 33.

Particularly, in the case where there is fixed, for example, a circuit board of, e.g., the vibration detection board 33 or the attachment body 30 for mounting the circuit board on an article, such fixation is normally made via a screw for allowing replacement of the same. In this case, either a screw hole is drilled on the mounting subject, or an attachment seat is fixed thereto. If the mounting subject is the casing 2 made of metal, either a screw hole needs to be drilled in the casing 2, or an attachment seat needs to be fixed thereto by, e.g., welding. Meanwhile, in order to secure the precision or strength of the casing 2, it is desirable to minimize the drilling of screw holes or the fixation that is made by the welding of the mounting seat. Specifically, as for the Stirling refrigerator 1 of the type in accordance with the present embodiment, since the casing 2 has a high pressure inside, it is necessary to minimize a processing that may potentially decrease the strength or precision thereof. In contrast to this, according to the present embodiment, the vibration detection board 33 is attached to the second connection part 22, which thereby avoids an unnecessary processing such as drilling or welding that may potentially have an adverse effect to the strength or precision thereof. Accordingly, the casing 2 can retain a high precision or strength. That is, even if a screw hole is drilled in the second connection part 22 or a mounting seat is fixed thereto by, e.g., welding, these screw holes or mounting seat bring no harm to the strength or precision of the casing, which therefore enhances the reliability of the Stirling refrigerator 1.

Further, as described above, the diameter D1 of the second connection part 22 is smaller than the diameter D2 of the body portion 4 and the diameter D3 of the damping unit 20. Furthermore, as mentioned above, mounted on the short cylindrical portion 23 of the second connection part 22 having a small diameter is the attachment body 30 to which the vibration detection board 33 serving as a vibration detector is fixed; the vibration detection board 33 is fixed to the inner side of the board attachment portion 31 of the attachment body 30. That is, the vibration detection board 33 is mounted on a portion constricted in contour of the Stirling refrigerator 1. Although it is not necessarily essential, it is desired that the distance from the central axis line A to the outer end of the attachment body 30 is smaller than the distance from the central axis line A to the outer end of the body portion 4 or the damping unit 20. By virtue of this configuration, it may be configured that the outer end of the attachment body 30 is not protruded to the outside beyond the outer end of the body portion 4 or the damping unit 20 or that even if it protrudes, it does not protrude significantly. The vibration detection board 33, therefore, makes minimal impact on the overall size of the Stirling refrigerator 1.

Further, the vibration detection board 33 may be fixed to the second connection part 22 via the attachment body 30 to thereby enhance thermal reliability. That is, the heat from the drive mechanism 10 housed in the body portion 4 as well as the heat generated at the reverse Stirling cycle cause the body portion 4 to have a relatively high temperature. For this reason, if the vibration detection board 33 is fixed on the body portion 4, it will be affected by these heats. However, if the vibration detection board 33 is fixed to the second connection part 22 which is distant from the body portion 4, such heat influences can be reduced.

As explained above, the present invention provides a Stirling refrigerator 1 as being a reciprocating motion engine comprising: a casing 2; a cylinder 7 arranged within the casing 2; a piston 9 capable of being reciprocated within the cylinder 7 in a reciprocating direction R as being uniaxial; a control circuit 43 electrically controlling movement of the piston 9; and a damping unit 20 provided at one end side of the casing 2 in the reciprocating direction R via a first connection part 21 and a second connection part 22 serving as connection parts; wherein the reciprocating motion engine further comprises a vibration detection board 33 arranged via an attachment body 30 on the second connection part 22, said vibration detection board 33 serving as a vibration detector to detect a vibration in the reciprocating direction R that is caused by the reciprocating movement of the piston 9, and then transmit it to the control circuit 43. Hence, the attachment of the vibration detection board 33 does not adversely influence the casing 2 in terms of strength and precision to thereby provide a Stirling refrigerator 1 of high reliability.

Further, according to the present invention, the second connection part 22, constituting the connection part, has a dimension (diameter D1) smaller than the dimension of the casing 2 or damping unit 20 (diameter D2 or D3) in a direction orthogonal to the central axis line A that is parallel to the reciprocating direction R to thereby allow vibration detection board 33 to have minimal influence on the overall size of the Stirling refrigerator 1.

Further, according to the present invention, there is utilized an acceleration sensor 34 that is implemented in the vibration detection board 33 to thereby determine the amplitude of the piston based on the magnitude of the detected acceleration to control the amplitude of the piston 9.

Furthermore, according to the present invention, as the device element 36 of the acceleration sensor 34 has a dimension that is smaller along the direction of detection axis Z than the dimensions along the directions of detections axes X and Y, and the direction of detection axis Z, as being the direction axis along which the device element 36 of the acceleration sensor 34 has the smallest dimension, is arranged to be orthogonal to the central axis line A that is in parallel with the reciprocating direction R, there can be avoided a decrease in sensitivity of the detection signal to suppress reactivity deterioration in vibration detection to thereby control movement of the piston 9 with a high degree of accuracy.

It should be noted that the present invention is not limited to the above embodiments, and various modifications can be made within the scope of the gist of the invention. For example, the vibration detection board 33 may be fixed to the first connection part 21 as an alternative to the above-described embodiment in which the vibration detection board 33 is fixed via the attachment body 30 to the second connection part 22. Further, the vibration detection board 33 may be accommodated in a space inside of the connection part as an alternative to the above-described embodiment in which the vibration detection board 33 is fixed on the outside of the second connection part 22. Further, the acceleration sensor 34 may be configured such that the direction of the detection axis of the largest dimension of the device element 36 among detection axes X, Y, Z is in parallel with the reciprocating direction R. Accordingly, as for the acceleration sensor 34 that is utilized in the present embodiment, the detection axis X may be set to be in parallel with the reciprocating direction R. Further, the reciprocating motion engine of the present embodiment is a Stirling refrigerator 1, but the engine may be other reciprocating motion engines such as a Stirling engine.

LIST OF REFERENCE NUMERAL

1 Stirling refrigerator (reciprocating motion engine)
2 casing
4 second casing body
7 cylinder
9 piston
20 damping unit
21 first connection part (connection part)
22 second connection part (connection part)
33 vibration detection board (vibration detector)
34 acceleration sensor
36 device element
43 control circuit
R reciprocating direction (uniaxial direction)
X, Y, Z detection axis

The invention claimed is:

1. A reciprocating motion engine comprising:
a casing;
a cylinder arranged within the casing;
a piston capable of being reciprocated in an axial direction within the cylinder;
a control circuit to electrically control a movement of the piston;
a damping unit provided at a one end side of the casing in the axial direction via a connection part; and
a vibration detector to detect a vibration in the axial direction that is caused by a reciprocating movement of the piston, and then transmit a corresponding detection signal to the control circuit, wherein
the vibration detector is provided at the connection part, and
the damping unit and the connection part are coaxially provided outside the casing.

2. The reciprocating motion engine according to claim 1, wherein a dimension of the connection part in a direction orthogonal to the axial direction is formed smaller than a dimension of the casing or the damping unit in a direction orthogonal to the axial direction.

3. The reciprocating motion engine according to claim 1, wherein an acceleration sensor is utilized in the vibration detector.

4. The reciprocating motion engine according to claim 3, wherein the acceleration sensor has a device element having dimensions that differ from one another in respective detection axis directions among which a detection axis direction corresponding to the smallest dimension of the device element of the acceleration sensor is orthogonal to the axial direction.

* * * * *